United States Patent [19]

King

[11] 4,453,720

[45] Jun. 12, 1984

[54] FIELD GAME

[76] Inventor: David G. King, 39 Betsy B Ave., Somerset, Mass. 02725

[21] Appl. No.: 525,231

[22] Filed: Aug. 22, 1983

[51] Int. Cl.[3] ..... A63B 71/02; A63B 37/14

[52] U.S. Cl. ..... 273/411; 273/58 K

[58] Field of Search ..... 273/411, 58 R, 58 K, 273/428

[56] References Cited

U.S. PATENT DOCUMENTS

| | | | |
|---|---|---|---|
| 2,187,524 | 1/1940 | Price | 273/58 K X |
| 2,580,799 | 1/1952 | Lauterbach | 273/411 X |
| 3,602,505 | 8/1971 | Friend | 273/411 X |

FOREIGN PATENT DOCUMENTS

| | | | |
|---|---|---|---|
| 1405454 | 9/1975 | United Kingdom | 273/58 K |

*Primary Examiner*—William H. Grieb

*Attorney, Agent, or Firm*—William Nitkin

[57] ABSTRACT

A game involving players of two opposing teams, each of said players positioned on a zone on a playing field, which field has a plurality of concentric circles intersected by perpendicular lines through the center thereof forming four quarters, the outermost zone being a safety ring, the next adjacent being a back ring, the next adjacent being a pivot ring, the next adjacent being a core ring, the next adjacent being a guard ring within which is centrally located a point ring. The game is played with a ball having a plurality of raised concave sections on its surface.

6 Claims, 2 Drawing Figures

FIELD GAME

BACKGROUND OF THE INVENTION

1. Field of the Invention

This invention relates to games and more particularly relates to a ball game played on a new and unique playing field/court.

1. History of the Prior Art

Ball games such as basketball and football are very well known. These games utilize balls of a special design and are played on a specific playing field/court. The ball is bounced, carried or thrown from player to player during the game. These games involve substantial body contact and the body contact especially in football causes many injuries.

SUMMARY OF THE INVENTION

An object of the present invention is to provide a new team game with a novel playing field and player arrangement utilizing a new style of playing ball which new game has no body contact but still has the excitement of a contact sport. The playing field which may be disposed on an outdoor field or an indoor court is circular with a plurality of concentric circles divided into quarters by intersecting perpendicular lines forming a plurality of zones with a point ring or goal being located in the center of the field. Players of two teams are arranged with the players of each team in alternating zones. A ball having a plurality of raised concave segments therearound for ease of grasping is utilized and is passed from player to player of the same team. In a preferred embodiment the concentric circles within each quarter formed by the intersecting perpendicular lines have six zones, the innermost zone being designated as a point ring. Around the point ring is formed a neutral line. The zones extending out from the center are a guard ring, a core ring, a pivot ring, a back ring and a safety ring. The players of each team are arranged alternately in these ring zones. For example in a quarter of the field, if a player of team A is in the point ring, then a player of Team B is in the guard ring, while a player of Team A is in the core ring, the players alternating out to the safety ring. The players in adjacent quarters also alternate with the adjacent quarter's zones. For example, the adjacent quarter to the one just mentioned would have a player of Team B in the point ring, a player of Team A in the guard ring, a player of Team B in the core ring, the team players alternating out to the safety ring. A player can move within his zone ring only to the intersecting lines forming the quarters. A player may not move out of his zone ring. The object of the game is to throw the ball to a team member in the point ring while players on the other team try to block such action and intercept the ball so that their team can try to score. Only players beyond the guard ring can attempt to throw to their team member in the point ring to score a point. The players may throw the ball to other members of their team in other zones or even in other quarters to gain advantage if an opposing player is out of position as the other team member may have a more advantageous chance of scoring. No players are allowed to step on or cross the neutral ring. The ball is initially placed into play by a player in the outermost safety ring. Also the player in the safety ring is the last player with the opportunity to catch a ball before it goes outside of the playing field. The ball may be thrown either to attempt to score a point in the point ring or to another member of the team in the players quarter or in another quarter. The ball may be thrown, bounced, rolled or tapped with the hands between any of the twelve players of each team. The players of the other team, though, try to prevent the opposing team from scoring by intercepting the ball. It is an object to maneuver the ball from zone to zone and quarter to quarter to attempt to get a clear shot to one of the team's point players. The game may have referees and various time periods of play depending on the age and level of skill and competition of the players. Much strategy is utilized as the players are always moving within their zones to obtain the best and most advantageous field positions. The players do not have to bounce the ball as they can carry it from one portion of the zone to the other and the players in the adjoining zones, being players of the opposing team can attempt to block or intercept any pass or shot to another ring or to the point ring. Players in the guard ring have a unique position in that they cannot score points but must try to prevent the opposing team from scoring. If a guard intercepts a scoring attempt from the opposing team, he must clear the ball out to the safety zone before his team can attempt to score. In some embodiments, a small portion of the center of the field may be also designated as a neutral zones where players are not allowed to enter.

It is a further object of this invention to provide a team sport which, because of the game's lack of body contact, members of both sexes can participate in together. There is no particular advantage to a player being taller, stronger, or faster than other players. It is also a game which younger players who may not be allowed to engage in heavy contact sports can safely play. Due to the no contact rule, players cannot come into contact with any other player, either on their team or on the opposing team. A player who makes contact with an opposing player within the opposing player's zone commits a personal foul. Players must learn to pass the ball to a moving receiver, often when they themselves are moving within their own zone and as a result they develop skill and co-ordination.

DESCRIPTION OF THE PREFERRED EMBODIMENT(S)

Figure 1:
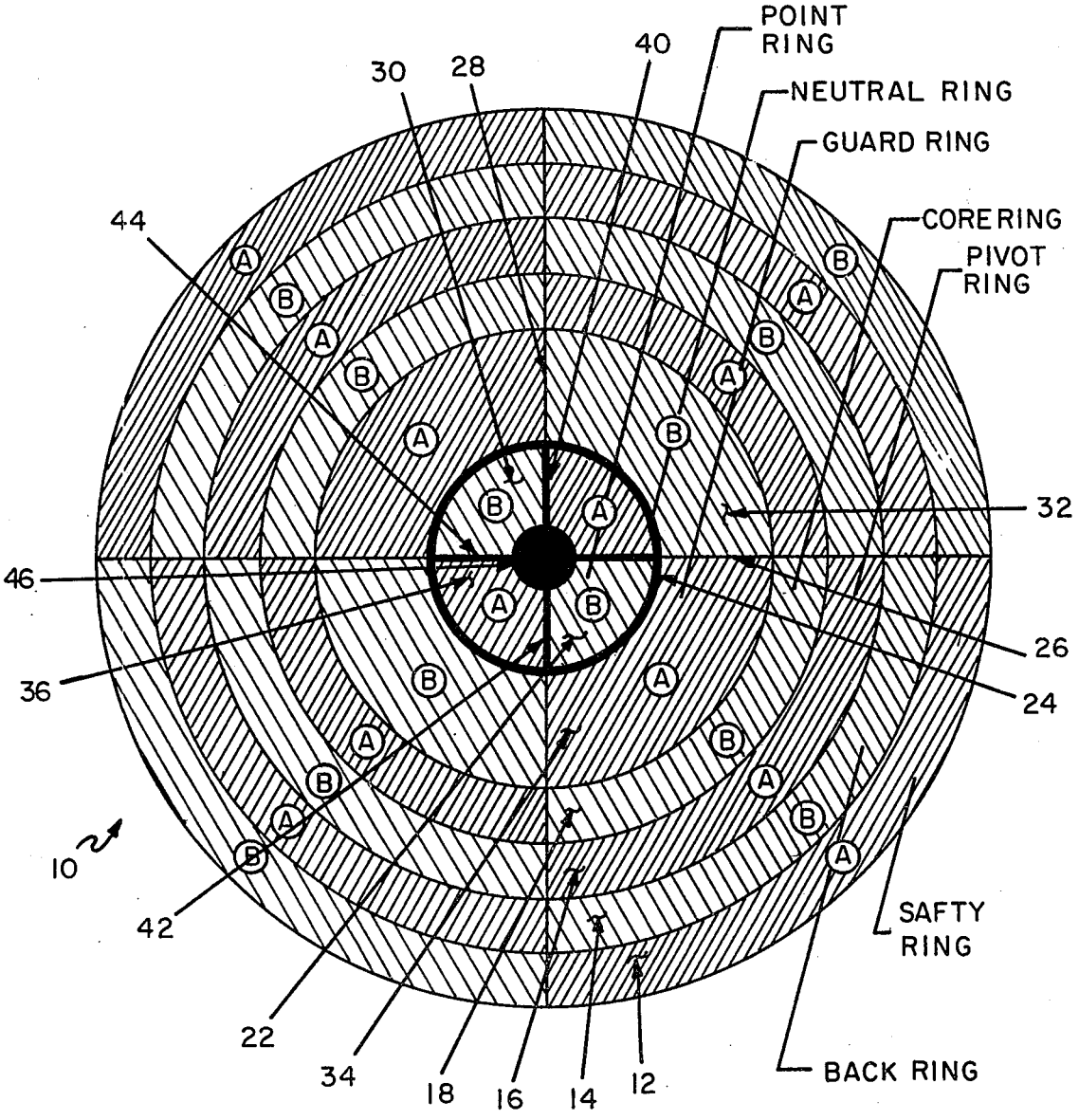
FIG. 1 is a plan view of the playing field/court of this invention.

FIG. 1 is a plan view of the playing field of this invention which is circular and generally designated by the number 10. The field has a plurality of concentric zones formed therein, the outer being the safety ring zone 12. The next zone immediately inside of safety ring zone 12 is the back ring zone 14. The next inner zone is the pivot ring zone 16. The next inner zone is the core ring zone 18. All of the foregoing zones are of substantially similar width while the next innermost zone, the guard ring zone 20 is approximately twice the width of the preceding zones. Inward of the guard ring zone 20 is the point ring zone 22 which is surrounded by a narrow neutral ring zone 24. The field is intersected by two perpendicular lines 26 and 28 forming four quarter 30, 32, 34 and 36. The portions of the intersecting lines 26 and 28 within the point ring 22 may be widened to form additional neutral zones 38, 40, 42 and 44 while the very center of the circle can form an additional neutral zone 46. Players of Team A and Team B can populate the zones in alternate rings, the players further being in different alternate rings in adjoining quarters. The field is marked with a typical layout of players designated as members of Teams A or B by small circles containing an A or B notation. The field may be of any size selected depending upon the age and ability of the players but in a preferred embodiment for adult players, the field may be of 154 feet in diameter.

In some embodiments where there are fewer players, one-half court games may be played using two adjacent quarters or two opposite quarters. Players who contact other players or who step on the zone boundary lines commit a foul. Other fouls may occur for many reasons, including holding onto the ball for more than 10 seconds before passing or shooting or kicking the ball instead of passing it. Penalties for fouls may be to allow a free shot for the opposing team from the safety zone to one of its point zone players with the entire quarter of the field between them emptied of players.

There are different point valuations attached to the various zones, making the movement of the ball important to scoring strategies. Point valuations are determined by the last player, regardless of which team, to make contact with the ball before the ball reaches and is secured by the point player. The chart set out below outlines a typical point scoring system.

| Last Player Contact | | | Value |
|---|---|---|---|
| Safety Player | to | Point Player - either team | 4 |
| Back Player | to | Point Player - either team | 3 |
| Pivot Player | to | Point Player - either team | 2 |
| Core Player | to | Point Player - either team | 2 |
| Point Player | to | Point Player - either team | 2 |
| Guard Player | to | Point Player - same team | 0 |
| Guard Player | to | Point Player - opposing team | * |

*In this situation, the point valuation is determined by the player (either team), that made contact immediately preceding the Guard Player. This is also contingent on whether or not the clearing rule was observed if applicable.

Figure 2:
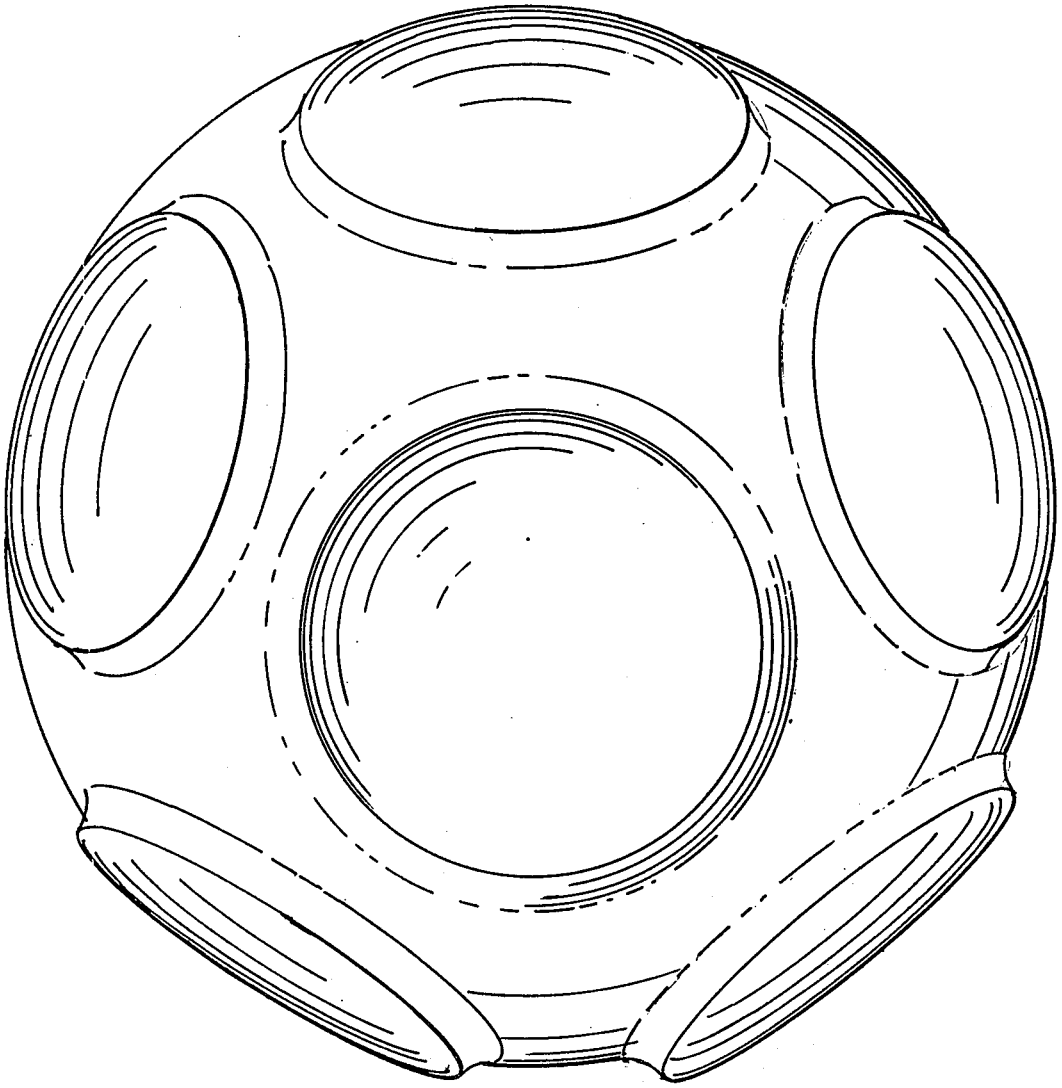
FIG. 2 is a elevational view of the playing ball of this invention.

The players of a team throw a ball 50 as seen in FIG. 2 from one to the other from zone to zone as described above and attempt to score points by throwing it to their player in the point ring zone. The ball is spherical and is approximately 7" in diameter with twelve raised concave sections 60 arrayed equidistant from one another around the entire outer surface of the ball. These concave raised sections are approximately 3" diameter and ¼" high. The center of each concave portion has a height of approximately 1/16" from the ball's surface. The ball can be of the inflatable type and the object of including the raised concave sections is so that the ball can be easily grasped in one or two hands.

Although the present invention has been described with reference to particular embodiments, it will be apparent to those skilled in the art that variations and modifications can be substituted therefor without departing from the principles and spirit of the invention.

I claim:

1. A game involving players of a first and second opposing teams, each attempting to score points by throwing an object to a specified area, said game comprising:

a playing field having a plurality of concentric circles intersected by perpendicular lines through the center thereof forming a plurality of zones in quarters, the outermost being a safety zone, the next adjacent being a back zone, the next adjacent being a pivot zone, the next adjacent being a core zone, said outer safety, back, pivot, and core zones being of substantially the same width, the next innermost zone being a guard zone being of approximately twice the width of said outer zone with a point zone ring formed inside of said guard zone, and said players of said opposing teams individually populating said zones alternately on each concentric zone within a quarter and alternately in adjacent quarters.

2. The game of claim 1 further including a first neutral zone disposed between said point zone and said guard zone.

3. The game of claim 2 further including a second neutral zone disposed in the center of said playing field surrounded by said point zone.

4. The game of claim 3 further including additional neutral zones along each intersecting perpendicular line between said first neutral zone and said second neutral zone.

5. The game of claim 1 wherein said throwing object comprises a spherical ball having a plurality of raised concave sections spaced on its outer surface.

6. The game of claim 5 wherein said ball includes 12 of said raised sections, each approximately 3" in diameter and ¼" in height at their outer edge and wherein the inner portion of said concave section is approx. 1/16" from the surface of the ball member.

* * * * *